US006250960B1

(12) United States Patent
Youtsey

(10) Patent No.: US 6,250,960 B1
(45) Date of Patent: Jun. 26, 2001

(54) FEMALE TO FEMALE CATV SPLICE CONNECTOR

(75) Inventor: Timothy L. Youtsey, Mesa, AZ (US)

(73) Assignee: PCT International, Inc., Gilbert, AZ (US)

( * ) Notice: Subject to any disclaimer, the term of this patent is extended or adjusted under 35 U.S.C. 154(b) by 0 days.

(21) Appl. No.: 09/615,084

(22) Filed: Jul. 12, 2000

(51) Int. Cl.[7] ..... H01R 9/05
(52) U.S. Cl. ..... 439/578; 439/638
(58) Field of Search ..... 439/578, 638, 439/650

(56) References Cited

U.S. PATENT DOCUMENTS

| | | | | |
|---|---|---|---|---|
| 5,096,444 | | 3/1992 | Lu et al. . | |
| 5,498,175 | | 3/1996 | Yeh et al. . | |
| 5,667,409 | | 9/1997 | Wong et al. . | |
| 5,700,160 | | 12/1997 | Lee . | |
| 5,730,622 | * | 3/1998 | Olson | 439/578 |
| 5,830,010 | | 11/1998 | Miskin et al. . | |
| 5,863,226 | * | 1/1999 | Lan et al. | 439/852 |
| 5,865,654 | | 2/1999 | Shimirak et al. . | |
| 6,065,997 | * | 5/2000 | Wang | 439/578 |
| 6,113,431 | * | 9/2000 | Wong | 439/638 |

* cited by examiner

*Primary Examiner*—Khiem Nguyen
*Assistant Examiner*—Thanh-Tam Le
(74) *Attorney, Agent, or Firm*—Richard C. Litman

(57) ABSTRACT

A female to female CATV splice connector having a generally cylindrical conductive housing, an axially located conductive cable-engaging member or seizure element and a hollow, elongated insulating member surrounding the seizure element and which is fitted into the cylindrical housing. The conductive cable-engaging member is a female-female inner coaxial cable receptacle and has an elongated intermediate section, two conductive cable engaging units extending lengthwise from the ends of the intermediate section. The conductive cable-engaging member is made of a BeCu alloy which is corrosion resistant. The design of the elongated intermediate section exhibits superior electrical properties over prior connecting systems. More particularly, the elongated intermediate section is specifically sized to obtain good impedance matching at 75 ohms. The mass of the intermediate section determines capacitance, and the shape of this section determines the inductance of the unit. The intermediate section design of the present invention having two parallel and opposed portions is optimum for the practice of the present invention.

16 Claims, 5 Drawing Sheets

FEMALE TO FEMALE CATV SPLICE CONNECTOR

BACKGROUND OF THE INVENTION

1. Field of the Invention

The present invention relates to a female to female cable television(CATV) splice connector and, more particularly, such a connector having a seizure element which engages the center conductor of a male cable at each end, and which is so designed and having such material of construction as to obtain a reduction of return loss of the radio frequency signal with minimal impedance mismatching, retaining its 75 ohm characteristics over a broad range of frequencies.

2. Description of the Related Art

The related art describes various CATV female splice connectors having a variety of seizure element configurations. The art of interest will be discussed in the order of their perceived relevance to the present invention.

U.S. Pat. No. 5,700,160 issued on Dec. 23, 1997, to Chum-Te Lee describes an electrical connector for interconnecting female and male contacts of cables such as CATV coaxial cables. A female engaging unit and a male engaging unit are connected by an intermediate section to form a conductive cable-engaging member. The conductive cable-engaging member is supported in a fixed position by an insulating member which is configured as a container with a hinged cover where upon assembly the conductive cable engaging member is placed within the container having an internal configuration so as to match the configuration of the conductive cable-engaging member and the hinged cover is closed and held with engaging members extending from the base of the container through corresponding openings in the cover. The present invention has two female engaging units at either end of the conductive cable engaging member separated by an integral elongated intermediate section. The intermediate section of the reference is made up of two parallel members, both of which are attached to what the reference female engaging unit would be described as a connecting wall in the generally "C" shaped engaging unit, while the intermediate section of the present invention is made up of two members, each of which is attached at opposing upper and lower portions of the engaging unit. The reference members of the intermediate section run parallel edge along edge while the intermediate section of the present invention run parallel members facing each other. The inventive insulating and support member is a split case design which better conforms to the inner surface of the generally cylindrical conductive housing.

U.S. Pat. Nos. 5,498,175 and 5,667,409, issued on Mar. 12, 1996 and Sep. 16, 1997 to Yeh et al. and Wong et al., respectively, describe female to female coaxial cable connectors, but do not employ a conductive cable engaging member or an insulator and support member having any similarity to those of the present invention.

U.S. Pat. No. 5,096,444; issued on Mar. 17, 1992, to Luet al. describes a female to female CATV coaxial cable connector having female inner coaxial cable receptacles in either end of an annular insulator similar to the present invention. The 444 each occurance patent has a similar end structure to that of the assembled end portions of a generally cylindrical conductive housing similar to the present invention. The conductive cable engaging member of the 444 each occurance patent differs substantially in design from that of the present invention, providing no comparable elongated intermediate section disposed between the two engaging units of the 444 each occurance patent.

U.S. Pat. No. 5,865,654, issued on Feb. 2, 1999 to Shimirak et al. describes a female to female connector for coaxial cables which considers characteristics such as impedance matching. The structure of the conductive cable engaging unit and the insulator and support member differ substantially from corresponding elements of the present invention.

U.S. Pat. No. 5,830,010, issued on Mar. 17, 1992 to Miskin et al. describes an impedance matched connector for data transmission cable. The conductor and the shield of the cable are attached to individual prongs which fit over a bar-shaped receiving structure. The present invention, although providing for impedance matching is distinct in that the connector is for a coaxial cable and necessarily features substantially different structure from the '010 patent.

None of the above inventions and patents, taken either singularly or in combination, is seen to describe the instant invention as claimed. Thus a female to female splice connector solving the aforementioned problems is desired.

SUMMARY OF THE INVENTION

According to the present invention, the female to female CATV splice connector has a generally cylindrical conductive housing having an axially located conductive cable-engaging member or seizure element and a hollow, elongated insulating member surrounding the seizure element and which is fitted into the cylindrical housing. The conductive cable-engaging member is a female to female inner coaxial cable receptacle and has an elongated intermediate section. Two conductive cable engaging units extend lengthwise from the ends of the intermediate section. The conductive cable-engaging member is made of a BeCu alloy which is corrosion resistance and, with the proper design of the elongated intermediate section exhibits superior electrical properties over prior connecting systems. More particularly, the elongated intermediate section is specifically sized to obtain good impedance matching at 75 ohms. Performance is tripled from prior connectors from about −18 dB to about −45 dB. The mass of the intermediate section determines capacitance, and the shape of this section determines the inductance of the unit. The intermediate section design of the present invention having two parallel and opposed portions is optimum for the practice of the present invention.

Accordingly, it is a principal object of the invention to provide a female-female CATV splice connector for splicing two coaxial cables having male connector terminals which has greatly reduced impedance mismatch, thereby reducing the loss of radio frequency signal.

It is another object of the invention to provide a conductive, cable-engaging member constructed of a corrosion-resistant material.

It is a further object of the invention to provide a female-female CATV splice connector having a conductive cable-engaging member element exhibiting superior electrical characteristics.

Still another object of the invention is to provide a female-female CATV splice connector as described above having an elongated intermediate section of such mass and configuration and made of such material as to exhibit superior impedance matching at 75 ohms.

It is yet a further object of the invention to provide a female-female CATV splice connector having an elongated conductive cable-engaging member element as described above and constructed of a BeCu alloy material.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a female-female CATV splice connector having a generally cylindrical conductive housing which has an axially located conductive cable-engaging member or seizure element and a hollow, elongated insulating member surrounding the seizure element and which is fitted into the cylindrical housing. The conductive cable-engaging member is a female-female inner coaxial cable receptacle and has an elongated intermediate section. Two conductive cable-engaging units extend lengthwise from the ends of the intermediate section. The conductive cable-engaging member is made of a BeCu alloy which is corrosion resistant and, with the proper design of the elongated intermediate section exhibits superior electrical properties over prior connecting systems. More particularly, the elongated intermediate section, is specifically sized to obtain good impedance matching at 75 ohms. Performance is tripled from prior connectors from about −18 dB to about −45 dB. The mass of the intermediate section determines capacitance, and the shape of this section determines the inductance of the unit. The intermediate section design of the present invention having two parallel and opposed portions is optimum for the practice of the present invention.

Figure 1:
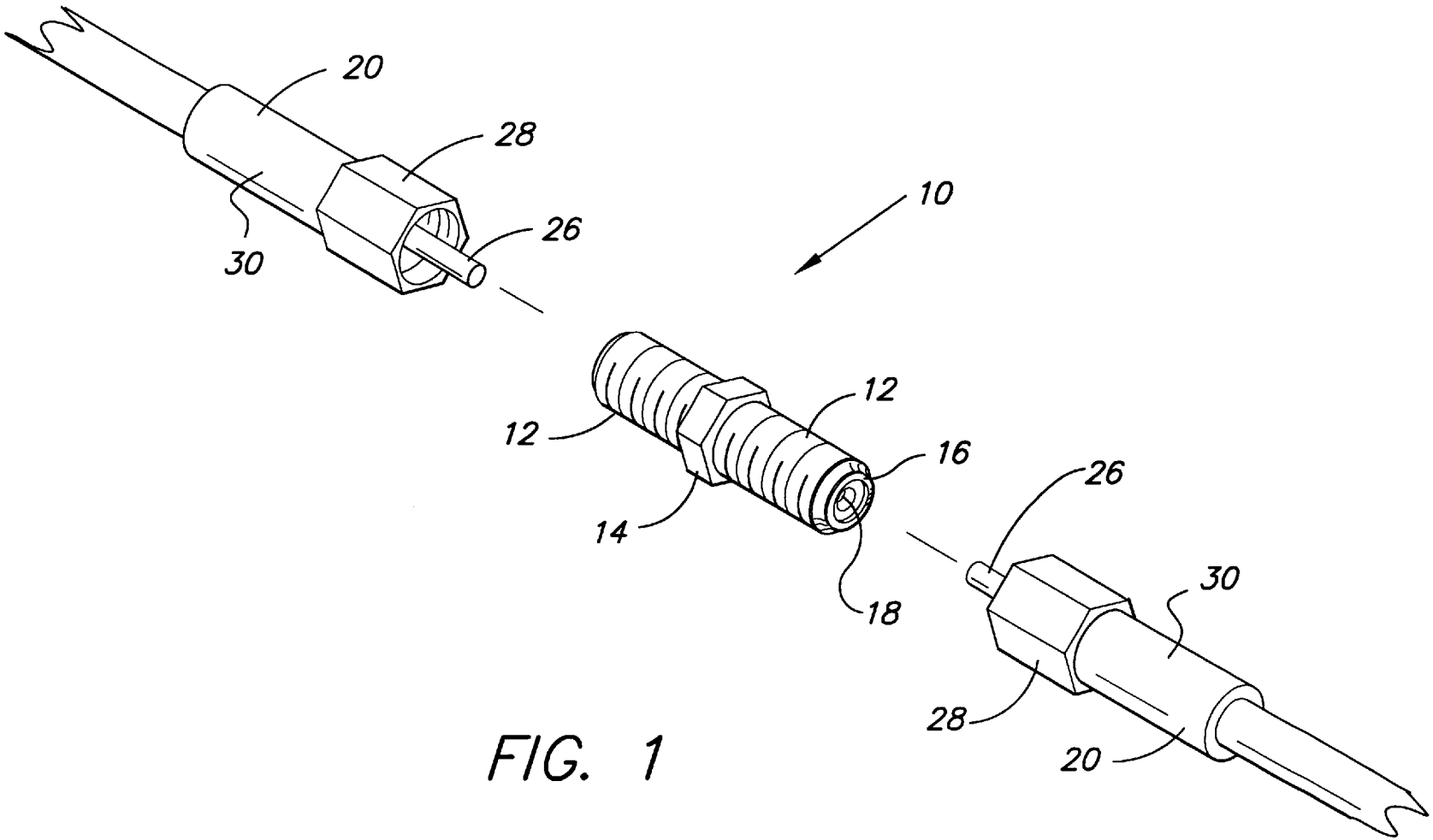
FIG. 1 is an environmental, perspective view of a female to female CATV splice connector according to the present invention.

Referring to FIG. 1, female-female coaxial cable splice connector 10 has a generally cylindrical conductive housing 11 having two threaded portions 12 and a central hexagonal portion 14 located therebetween. Insulator and support member 16 is adjacent to and annularly located within housing 11 and surrounds and supports female-female inner coaxial cable conductor receptacle 18.

Standard male coaxial connectors 20 are shown for illustration purposes and provide an assembly of parts for support of outer coaxial conductors (not shown), including elongated insulating members (not shown) electrically separating male inner coaxial conductors 26 from outer coaxial conductors. Male coaxial connectors 20 have outer hexagonal portions 28 so configured as to operatively engage with each of threaded portions 12 of generally cylindrical conductive housing 11 and to slidably engage male coaxial cable connector outer casings 30.

Figure 2:
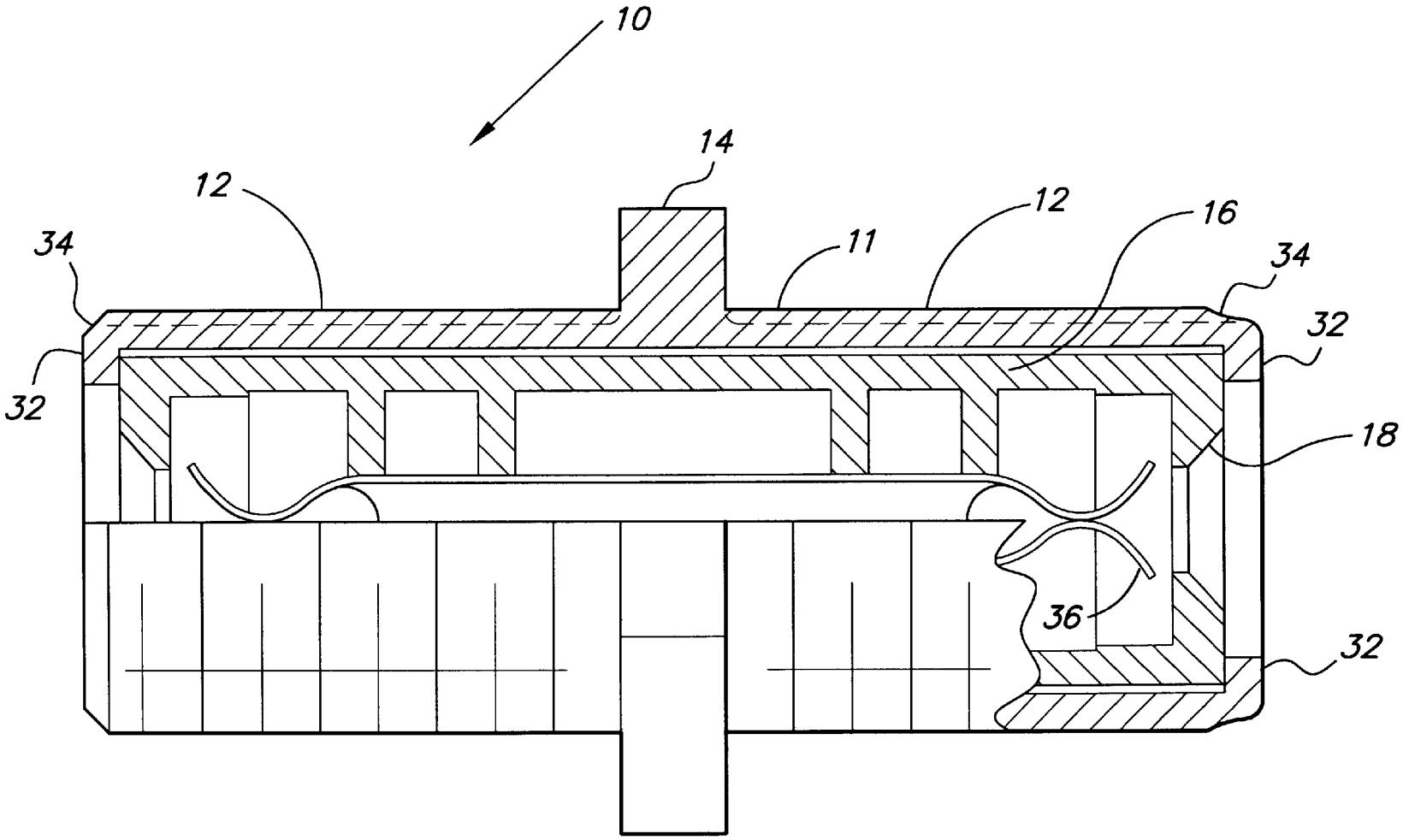
FIG. 2 is a partial vertical section view through a female to female CATV splice connector according to the present invention, the housing being fragmented to show the internal arrangement of parts.

Referring to FIG. 2, there is shown a partial section view of the connector 10 of the present invention further illustrating generally cylindrical conductive housing 11 having threaded portions 12, hexagonal portion 14, and lipped end portions 32 having chamfered portion 34. Chamfered portion 34 is configured to maintain electrical contact with an end portion of an outer coaxial conductor exposed within a male connector as in FIG. 1. As more clearly illustrated, insulator and support member 16 has an axially located female inner coaxial cable receptacle 18 at either end thereof and electrically isolates and physically supports conductive cable engaging member 36 relative to generally cylindrical conductive housing 11.

Figure 3:
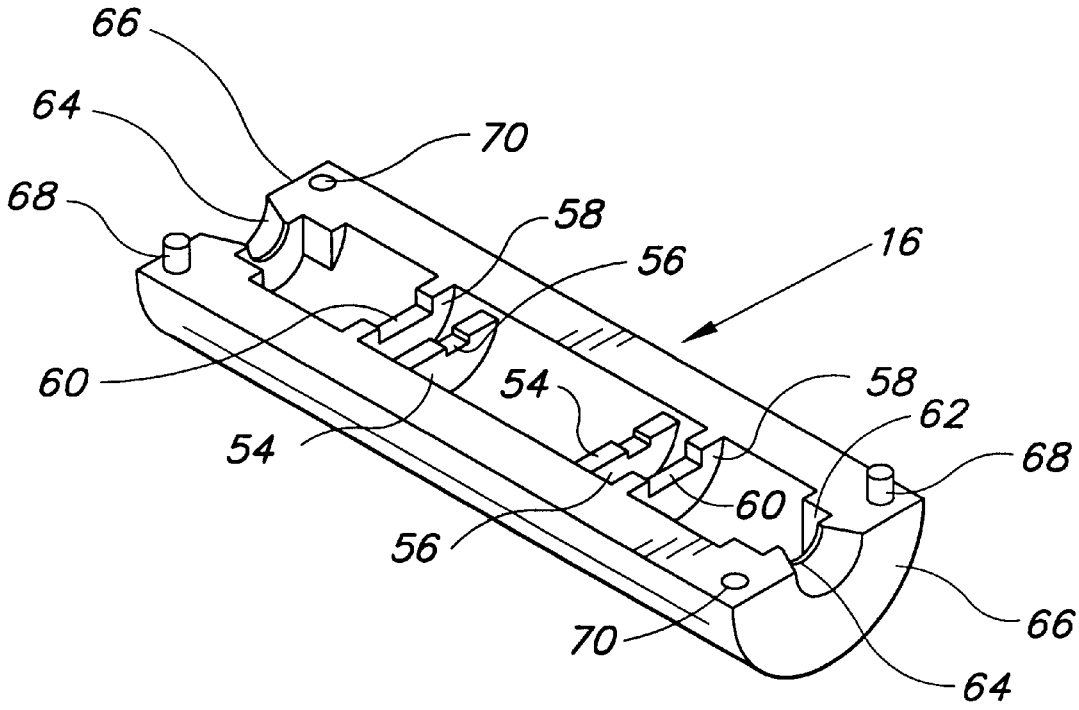
FIG. 3 is a perspective view of the insulator and support member of FIG. 1.

Referring to FIG. 3, there is shown a perspective view of a half portion of insulator and support 16, having inner insulator engaging member supports 54, each having a member support slot 56 therein, outer engaging member supports 58, each having a member support slot 60, end support cylinder 62 at either end, thereof and outwardly tapered end portions 64 at either end thereof and individually opening to respective insulator and support member ends 66. Insulator assembly pegs 68 fit into corresponding insulator assembly cavities 70 located within an identical half portion (not shown) of insulator and support member 16 and, likewise, insulator assembly cavities 70 receive corresponding insulator assembly pegs 68 located within the unshown half portion. Insulator and support member 16 is formed by fitting conductive cable engaging member 36 in one half portion of insulator and support member 16 and then fitting the remaining half with the first half through alignment and engagement of pegs 68 and corresponding cavities 70 thus completely surrounding conductive cable and support member 16.

Figure 4:
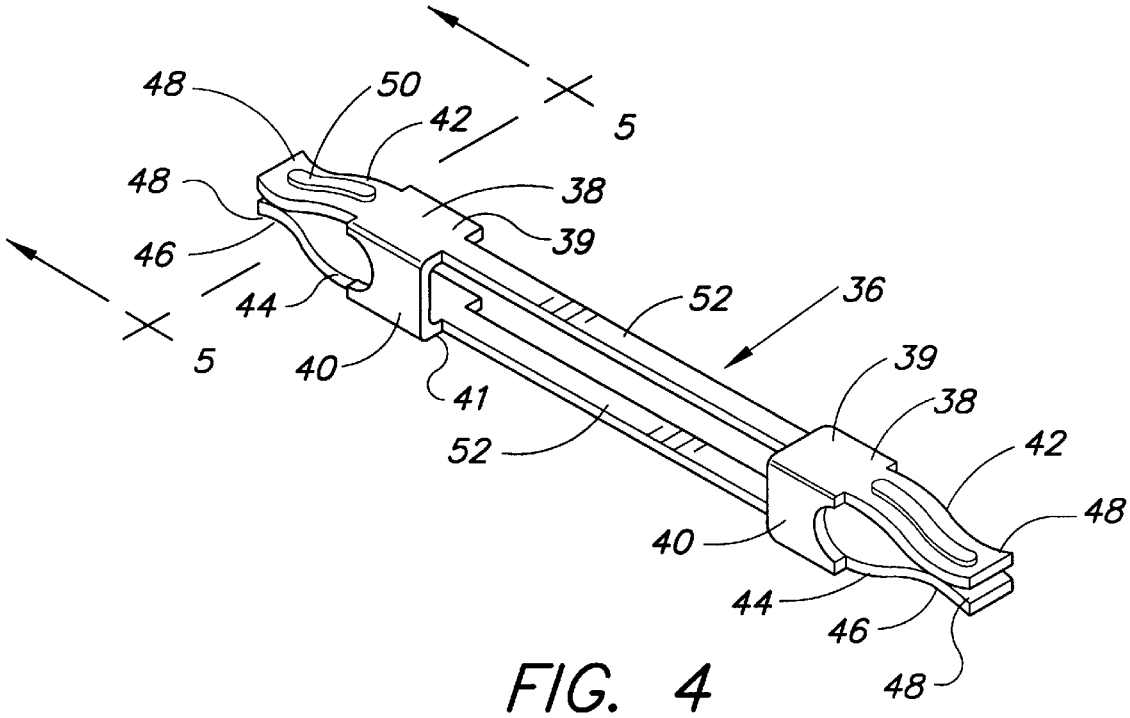
FIG. 4 is a perspective view of the seizure element of the splice connector of FIG. 1.

Referring to FIG. 4, there is shown a perspective view of conductive cable engaging member 36 having engaging units 38 which have upper engaging unit portion 39, vertical wall element 40, and lower engaging unit portion 41. Upper spring clip portion 42 and lower spring clip portion 44 extend from engaging units 38, and, more particularly, from upper engaging unit portion 39 and lower engaging unit portion 41, respectively. Vertical wall element 40 connects upper engaging unit portion 39 and lower engaging unit portion 41 of engaging units 38 to form a generally "C" shape.

Each clip portion 42 has a clip engaging portion 46 so configured as to be capable of engaging a male coaxial connector 20 (not shown) and having clip flared portion 48 so configured as to guide a male coaxial connector 20 into the clip engaging portion of engaging unit 38.

Figure 5:
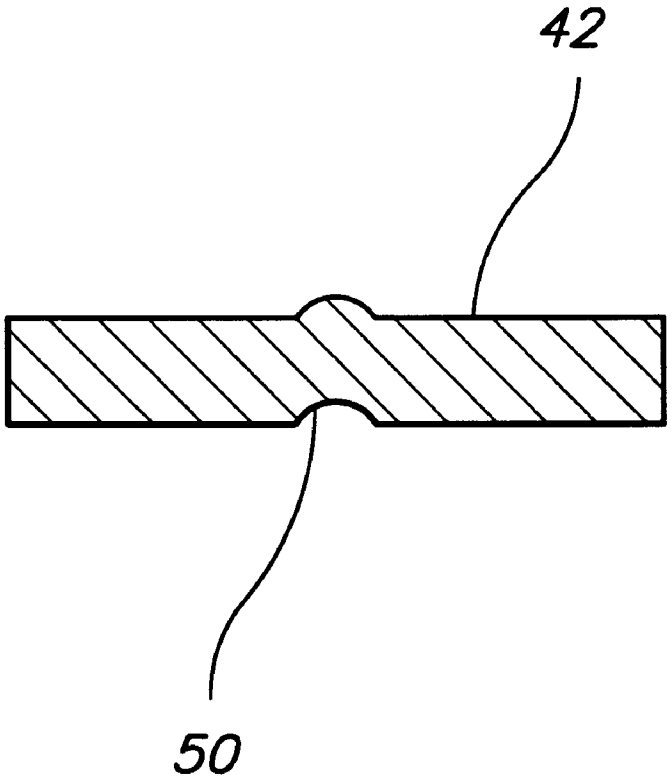
FIG. 5 is a section view along lines 5—5 of FIG. 4.

As better seen in FIG. 5, upper spring clip 42 has an indentation 50 to further assist in guiding the male coaxial connector 20 and to improve contact with clip 46 when male coaxial connector 20 is inserted in an engaging unit 38. A corresponding indentation 50 may also be formed on lower spring clip 42 for additional engagement with male coaxial connector 20 upon insertion.

Referring again to FIG. 4, engaging units 38 are separated by elongated intermediate sections 52. They extend between the upper portions 39 and lower portions 41 of engaging units 38, said engaging units being in a "C" shape in the vicinity of intermediate sections 52.

Elongated intermediate sections 52 are generally flat in shape and extend between and connect engaging units 38, one of each extending between each upper and each lower portion of engaging units 38. The width of elongated intermediate sections are generally less than upper and lower portions of engaging units 38 and extend from the central portions of each upper portion 39 and lower portion 41.

Conductive cable engaging member 36 and, in particular, elongated intermediate sections 52 are preferably made of an alloy of BeCu, and more particularly beryllium-copper alloy no. C-172 which is commercially available. This alloy provides for improved corrosion resistance over prior cable engaging elements. More importantly, the elongated intermediate sections 52 when properly sized results in improved impedance matching over prior cable engaging members at 75 ohms, typically from −18 dB in the prior art to −45 dB in the improved device of the present invention. The mass of alloy material in the intermediate sections 52 determine the capacitance, and the shape of the intermediate sections 52 determine the inductance exhibited thereby.

The generally cylindrical conductive housing 11 is typically made of brass having bright-acid tin-plate. The insulator and support member 16 is typically made of polyethylene plastic.

It is to be understood that the present invention is not limited to the embodiment described above, but encompasses any and all embodiments within the scope of the following claims.

I claim:

1. A female to female CATV splice connector for electrically connecting two coaxial cables which each terminate in a threaded male coaxial connector, the splice connector comprising:

a) a hollow, cylindrical, electrically conductive housing having a first threaded end, a second threaded end, and a hexagonal portion bisecting the first and second threaded portions;

b) a conductive cable engaging member having:

i) an engaging unit located at each opposite end of said conductive cable engaging member; and ii) an elongated intermediate section connecting said engaging units;

iii) said conductive cable engaging member having an elongated generally "C" shaped body, said engaging units having an upper portion, a lower portion, and a wall portion connecting said upper portion and said lower portion forming a generally "C" shape configuration, an upper spring clip portion extending outwardly from said upper portion, a lower spring clip portion extending outwardly from said lower portion, said upper spring clip and lower spring clip portions so configured and oriented so as to converge at a point remote from upper and lower portions of said engaging unit to form a clip engaging portion and thereafter diverging to form a clip flared portion; and c) an insulator disposed between said housing and said conductive cable engaging element, said insulator being of generally cylindrical shape and having an outer cylindrical wall, two inner insulator engaging member supports extending inwardly and normal to said outer cylindrical wall and equally spaced from the midpoint of said cylindrical insulator and having inner member support slots, two outer engaging member supports equally spaced from said inner insulator engaging member supports and similarly disposed and having outer member support slots, said inner and outer support slots being so configured as to receive and hold said conductive cable member, and two insulator and support member ends, each forming an axial end support cylinder having a tapered entrance.

2. The CATV splice connector of claim 1, wherein said elongated intermediate section comprises a first elongated portion extending between said upper engaging unit portions and a second elongated portion extending between said lower engaging unit portions of said engaging units.

3. The CATV splice connector of claim 1, said insulator being so shaped as to provide support to said conductive cable engaging member while electrically isolating it from said conductive housing.

4. The CATV splice connector of claim 2, wherein said "C" shaped body is made of an alloy of Beryllium and Copper.

5. The CATV splice connector of claim 4, wherein said alloy is a commercially available alloy designated as C-172.

6. The CATV splice connector of claim 1, wherein said clip engaging portion has facing grooves in either of said upper spring clip portion and said lower spring clip portion.

7. The CATV splice connector of claim 2, wherein said first and said second elongated portions are of such mass and configuration as to obtain desired impedance matching at 75 ohms.

8. The CATV splice connector of claim 1, wherein said insulator has a clamshell configuration, said conductive cable engaging member being partially inserted within a first half of the clamshell and a second half of the clamshell mated therewith so as to totally enclose said conductive cable engaging member.

9. A female to female CATV splice connector so configured as to electrically connect two male coaxial cable terminals comprising:

a) a generally cylindrical conductive housing having an outer surface having threaded portions separated by a central hexagonal portion;

b) an insulator and support member disposed annularly and immediately adjacent to an inner wall of said conductive housing; and c) a conductive cable engaging member axially located within said conductive housing, said conductive cable engaging member having an engaging unit located at each opposite end of said conductive cable engaging member and connected by an elongated intermediate section, said conductive cable engaging member further having an elongated generally "C" shaped body, said engaging units having an upper portion, a lower portion, and a wall portion connecting said upper portion and said lower portion forming a generally "C" shape configuration, an upper spring clip portion extending outwardly from said upper portion, a lower spring clip portion extending outwardly from said lower portion, said upper spring clip and lower spring clip portions so configured and oriented as to converge at a point remote from said upper and lower portions of said engaging unit to form a clip engaging portion, and thereafter diverging to form a clip flared portion, said insulator being generally cylindrically shaped, having an outer cylindrical wall, two inner insulator engaging member supports extending inwardly and normal to said outer cylindrical wall and equally spaced from the midpoint of said cylindrical insulator and having inner member support slots, two outer engaging member supports equally spaced from said inner insulator engaging member supports and similarly disposed and having outer member support slots, said inner and outer support slots being so configured as to receive and hold said conductive cable member, and two insulator and support member ends, each forming an axial end support cylinder having a tapered entrance.

10. The CATV splice connector of claim 9 wherein said elongated intermediate section comprises a first elongated portion extending between said upper engaging unit portions and a second elongated portion extending between said lower engaging unit portions of said engaging units.

11. The CATV splice connector of claim 9, said insulator being so shaped as to provide support to said conducive cable engaging member while electrically isolating it from said conductive housing.

12. The CATV splice connector of claim 9, wherein said "C" shaped body is made of an alloy of Beryllium and Copper.

13. The CATV splice connector of claim 12, wherein said alloy is a commercially available alloy designated as C-172.

14. The CATV splice connector of claim 10 wherein said clip engaging portion has facing grooves in either of said of upper spring clip portion and said lower spring clip portion.

15. The CATV splice connector of claim 9, wherein said insulator has a clamshell configuration, said conductive cable engaging member being partially inserted within a first half of the clamshell and a second half of the clamshell mated therewith so as to totally enclose said conductive cable engaging member.

16. A female to female CATV splice connector so configured to mate with two male coaxial cable connectors and having a generally cylindrical conductive housing having threaded portions separated by a central hexagonal portion, an insulator disposed annularly and immediately adjacent to an inner wall of said conductive housing, and a conductive cable engaging member axially located within said conductive housing, said conductive cable engaging member having an engaging unit located at each opposite end, separated and integral with an elongated intermediate section wherein said conductive cable engaging member has an elongated generally "C" shaped body, and wherein said engaging units have an upper portion, a lower portion, and a wall portion connecting said upper portion and said lower portion forming a generally "C" shape configuration, and upper spring clip portion extending outwardly from said upper portion, a lower spring clip portion extending outwardly from said lower portion, said upper spring clip and lower spring clip portions so configured and oriented as to converge at a point remote from upper and lower portions of said engaging unit to form a clip engaging portion and thereafter diverging to form a clip flared portion, said elongated intermediate section comprising a first elongated portion extending between said upper engaging unit portions and a second elongated portion extending between said lower engaging unit portions of said engaging units and wherein said "C" shaped body is made of a commercial alloy of Beryllium and copper designated as C-172, said first and second elongated portions are of such mass and configuration as to obtain desired impedance matching at 75 ohms, said insulator being so shaped as to provide support to said conductive cable engaging member while electrically isolating it from said conductive housing, said insulator being of a clamshell configuration, said conductive cable engaging member being partially inserted within a first half of the clamshell and a second half of the clamshell mated therewith so as to totally enclose said conductive cable engaging member, said insulator being of generally cylindrical shape and having an outer cylindrical wall, two inner insulator engaging member supports extending inwardly and normal to said outer cylindrical wall and equally spaced from the midpoint of said cylindrical insulator and having inner member support slots, two outer engaging member supports equally spaced from said inner insulator engaging member supports and similarly disposed and having outer member support slots, said inner and outer support slots being so configured as to receive and hold said conductive cable member, and two insulator and support member ends, each forming an axial end support cylinder having a tapered entrance.

* * * * *